US006884165B2

(12) United States Patent
Baerlocher

(10) Patent No.: US 6,884,165 B2
(45) Date of Patent: Apr. 26, 2005

(54) GAMING DEVICE HAVING MULTIPLE AWARD PROFILES

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 128 days.

(21) Appl. No.: 10/160,694

(22) Filed: May 31, 2002

(65) Prior Publication Data

US 2003/0224857 A1 Dec. 4, 2003

(51) Int. Cl.[7] ..... A63F 9/24
(52) U.S. Cl. ..... 463/16; 463/20
(58) Field of Search ..... 463/16, 20; 273/143 R

(56) References Cited

U.S. PATENT DOCUMENTS

| | | | | |
|---|---|---|---|---|
| 4,445,187 A | * | 4/1984 | Best | 463/31 |
| 4,624,459 A | | 11/1986 | Kaufman | |
| 4,695,053 A | | 9/1987 | Vazquez, Jr. et al. | |
| 5,456,465 A | | 10/1995 | Durham | |
| 5,823,874 A | | 10/1998 | Adams | |
| 5,848,932 A | | 12/1998 | Adams | |
| 5,882,261 A | | 3/1999 | Adams | |
| 6,004,207 A | | 12/1999 | Wilson, Jr. et al. | |
| 6,089,976 A | | 7/2000 | Schneider et al. | |
| 6,102,798 A | | 8/2000 | Bennett | |
| 6,126,542 A | | 10/2000 | Fier | |
| 6,146,273 A | | 11/2000 | Olsen | |
| 6,159,097 A | * | 12/2000 | Gura | 463/20 |
| 6,159,098 A | | 12/2000 | Slomiany et al. | |
| 6,168,520 B1 | | 1/2001 | Baerlocher et al. | |
| 6,168,523 B1 | | 1/2001 | Piechowink et al. | |
| 6,174,235 B1 | | 1/2001 | Walker et al. | |
| 6,203,429 B1 | | 3/2001 | Demar et al. | |
| 6,224,482 B1 | | 5/2001 | Bennett | |
| 6,231,442 B1 | | 5/2001 | Mayeroff | |
| 6,231,445 B1 | | 5/2001 | Acres | |
| 6,234,897 B1 | | 5/2001 | Frohm et al. | |
| 6,261,177 B1 | | 7/2001 | Bennett | |
| 6,270,409 B1 | | 8/2001 | Shuster | |
| 6,283,855 B1 | | 9/2001 | Bingham | |
| 6,299,165 B1 | | 10/2001 | Nagano | |
| 6,309,300 B1 | | 10/2001 | Glavich | |
| 6,312,334 B1 | | 11/2001 | Yoseloff | |
| 6,328,649 B1 | | 12/2001 | Randall et al. | |
| 6,346,043 B1 | | 2/2002 | Colin et al. | |
| 6,347,996 B1 | | 2/2002 | Gilmore et al. | |

(Continued)

FOREIGN PATENT DOCUMENTS

| | | |
|---|---|---|
| WO | WO 01/51143 A1 | 7/2001 |
| WO | WO 01/87441 A1 | 11/2001 |

OTHER PUBLICATIONS

Description of Let's Make a Deal Television Show written by www.ballygaming.com, printed Mar. 16, 2001.
Who Dunnit Advertisement written by WMS Gaming, Inc., published Jun. 26, 2001.
Top Dollar Advertisement written by IGT, published in 1998.
Texas Tea Advertisement written by IGT, published in 2000.
Winning Bid Advertisement written by WMS Gaming, Inc., published prior to 2002.

*Primary Examiner*—Julie Brocketti
(74) *Attorney, Agent, or Firm*—Bell, Boyd & Lloyd LLC

(57) ABSTRACT

A gaming device having a plurality of award profiles and a library of audio messages that the game uses in connection with the award profiles. The award profiles each include a series of award increases or decreases and at least one of the award profiles includes an award decrease. The player selects an item from a group of displayed items. The game selects one of the award profiles and an actor from a plurality of actors to provide the audio messages and one or more audio messages specific to the item, actor and profile. The game presents a video display of the actor providing the award changes, which the audio script accompanies.

67 Claims, 16 Drawing Sheets

U.S. PATENT DOCUMENTS 6,358,147 B1 * 3/2002 Jaffe et al. ..... 463/20
6,364,767 B1 4/2002 Brossard et al.
6,443,837 B1 9/2002 Jaffe et al.
6,508,709 B1 * 1/2003 Karmarkar ..... 463/42
6,547,242 B1 * 4/2003 Sugiyama et al. ..... 273/142 R

* cited by examiner

FIG. 6A

PROFILE TABLE

140

| 142 PROFILE | 144 REVIEW # 1 | 144 REVIEW # 2 | 144 REVIEW # 3 |
|---|---|---|---|
| # 1 | UP | UP | UP |
| # 2 | UP | UP | DOWN |
| # 3 | UP | DOWN | DOWN |
| # 4 | UP | DOWN | UP |
| # 5 | DOWN | UP | UP |
| # 6 | DOWN | UP | DOWN |
| # 7 | DOWN | DOWN | UP |
| # 8 | DOWN | DOWN | DOWN |

FIG. 6B

WEIGHTED PROFILE TABLE

150

| 142 PROFILE | 144 REVIEW # 1 | 144 REVIEW # 2 | 144 REVIEW # 3 | 152 LIKELIHOOD OF SELECTION |
|---|---|---|---|---|
| # 1 | UP | UP | UP | 5% |
| # 2 | UP | UP | DOWN | 10% |
| # 3 | UP | DOWN | DOWN | 15% |
| # 4 | UP | DOWN | UP | 20% |
| # 5 | DOWN | UP | UP | 20% |
| # 6 | DOWN | UP | DOWN | 15% |
| # 7 | DOWN | DOWN | UP | 10% |
| # 8 | DOWN | DOWN | DOWN | 5% |

FIG. 7

ACTOR 1
VIOLIN

160

142

162

| PROFILE | SCRIPT |
|---|---|
| # 1 | SCRIPT A |
| | SCRIPT B |
| | SCRIPT C |
| # 2 | SCRIPT A |
| | SCRIPT B |
| | SCRIPT C |
| # 3 | SCRIPT A |
| | SCRIPT B |
| | SCRIPT C |
| # 4 | SCRIPT A |
| | SCRIPT B |
| | SCRIPT C |
| # 5 | SCRIPT A |
| | SCRIPT B |
| | SCRIPT C |
| # 6 | SCRIPT A |
| | SCRIPT B |
| | SCRIPT C |
| # 7 | SCRIPT A |
| | SCRIPT B |
| | SCRIPT C |
| # 8 | SCRIPT A |
| | SCRIPT B |
| | SCRIPT C |

FIG 8A

INITIAL VALUE TABLE

180

182

| |
|---|
| 20 |
| 21 |
| 22 |
| 23 |
| 24 |
| 25 |
| 26 |
| 27 |
| 28 |
| 29 |
| 30 |
| 31 |
| 32 |
| 33 |
| 34 |
| 35 |
| 36 |
| 37 |
| 38 |
| 39 |
| 40 |
| 41 |
| 42 |
| 43 |
| 44 |
| 45 |
| 46 |
| 47 |
| 48 |
| 49 |
| 50 |

FIG 8B

WEIGHTED INITIAL VALUE TABLE

190

152

182

| | |
|---|---|
| 20 | 5% |
| 22 | 5% |
| 24 | 5% |
| 26 | 5% |
| 28 | 5% |
| 30 | 5% |
| 32 | 10% |
| 34 | 10% |
| 36 | 10% |
| 38 | 10% |
| 40 | 5% |
| 42 | 5% |
| 44 | 5% |
| 46 | 5% |
| 48 | 5% |
| 50 | 5% |

FIG. 9A

INCREMENTAL VALUE TABLE

200

| 142 PROFILE | 144 REVIEW # 1 | 144 REVIEW # 2 | 144 REVIEW # 3 |
|---|---|---|---|
| # 1 | +5<br>+10<br>+15<br>+20 | +5<br>+10<br>+15<br>+20 | +10<br>+25<br>+35<br>+50 |
| # 2 | +5<br>+10<br>+15<br>+20 | +15<br>+20<br>+25<br>+30 | -6<br>-7<br>-8<br>-10 |
| # 3 | +10<br>+25<br>+35<br>+50 | -2<br>-3<br>-4<br>-5 | -6<br>-7<br>-8<br>-10 |
| # 4 | +5<br>+10<br>+15<br>+20 | -6<br>-7<br>-8<br>-10 | +15<br>+20<br>+25<br>+30 |
| # 5 | -6<br>-7<br>-8<br>-10 | +5<br>+10<br>+15<br>+20 | +15<br>+20<br>+25<br>+30 |
| # 6 | -2<br>-3<br>-4<br>-5 | +10<br>+25<br>+35<br>+50 | -6<br>-7<br>-8<br>-10 |
| # 7 | -2<br>-3<br>-4<br>-5 | -6<br>-7<br>-8<br>-10 | +10<br>+25<br>+35<br>+50 |
| # 8 | -2<br>-3<br>-4<br>-5 | -2<br>-3<br>-4<br>-5 | -2<br>-3<br>-4<br>-5 |

202

FIG. 9B

WEIGHTED INCREMENTAL VALUE TABLE 142 144 144 144 210

| PROFILE | REVIEW # 1 | REVIEW # 2 | REVIEW # 3 |
|---|---|---|---|
| # 1 | +5 / 15%<br>+10 / 35%<br>+15 / 35%<br>+20 / 30% | +5 / 20%<br>+10 / 30%<br>+15 / 35%<br>+20 / 15% | +10 / 20%<br>+25 / 30%<br>+35 / 35%<br>+50 / 15% |
| # 2 | +5 / 15%<br>+10 / 35%<br>+15 / 35%<br>+20 / 15% | +15 / 20%<br>+20 / 30%<br>+25 / 35%<br>+30 / 15% | -6 / 15%<br>-7 / 35%<br>-8 / 35%<br>-10 / 15% |
| # 3 | +10 / 20%<br>+25 / 30%<br>+35 / 35%<br>+50 / 15% | -2 / 15%<br>-3 / 35%<br>-4 / 35%<br>-5 / 15% | -6 / 15%<br>-7 / 35%<br>-8 / 35%<br>-10 / 15% |
| # 4 | +5 / 15%<br>+10 / 35%<br>+15 / 30%<br>+20 / 20% | -6 / 15%<br>-7 / 35%<br>-8 / 35%<br>-10 / 15% | +15 / 20%<br>+20 / 30%<br>+25 / 35%<br>+30 / 15% |
| # 5 | -6 / 15%<br>-7 / 35%<br>-8 / 35%<br>-10 / 15% | +5 / 15%<br>+10 / 30%<br>+15 / 35%<br>+20 / 20% | +15 / 20%<br>+20 / 30%<br>+25 / 35%<br>+30 / 15% |
| # 6 | -2 / 15%<br>-3 / 35%<br>-4 / 35%<br>-5 / 15% | +10 / 15%<br>+25 / 30%<br>+35 / 35%<br>+50 / 20% | -6 / 15%<br>-7 / 35%<br>-8 / 35%<br>-10 / 15% |
| # 7 | -2 / 15%<br>-3 / 35%<br>-4 / 35%<br>-5 / 15% | -6 / 15%<br>-7 / 35%<br>-8 / 35%<br>-10 / 15% | +10 / 20%<br>+25 / 30%<br>+35 / 35%<br>+50 / 15% |
| # 8 | -2 / 15%<br>-3 / 30%<br>-4 / 35%<br>-5 / 20% | -2 / 15%<br>-3 / 30%<br>-4 / 35%<br>-5 / 20% | -2 / 15%<br>-3 / 35%<br>-4 / 35%<br>-5 / 15% |

152

202

FIG. 9C

ABSOLUTE AWARD TABLE

220

| 142 PROFILE | 144 REVIEW # 1 | 144 REVIEW # 2 | 144 REVIEW # 3 |
|---|---|---|---|
| # 1 | 55<br>60<br>65<br>70 | 75<br>80<br>85<br>90 | 100<br>115<br>125<br>140 |
| # 2 | 55<br>60<br>65<br>70 | 85<br>90<br>95<br>100 | 83<br>82<br>81<br>80 |
| # 3 | 60<br>75<br>85<br>100 | 55<br>56<br>57<br>58 | 45<br>49<br>51<br>53 |
| # 4 | 55<br>60<br>65<br>70 | 51<br>52<br>53<br>54 | 60<br>65<br>70<br>75 |
| # 5 | 12<br>14<br>16<br>18 | 25<br>35<br>40<br>45 | 60<br>65<br>70<br>75 |
| # 6 | 12<br>14<br>16<br>18 | 50<br>55<br>60<br>65 | 42<br>44<br>46<br>48 |
| # 7 | 12<br>14<br>16<br>18 | 4<br>6<br>8<br>10 | 20<br>35<br>45<br>60 |
| # 8 | 16<br>17<br>18<br>19 | 12<br>13<br>14<br>15 | 8<br>9<br>10<br>11 |

204

GAMING DEVICE HAVING MULTIPLE AWARD PROFILES

CROSS REFERENCE TO RELATED APPLICATIONS

The present invention relates to the following co-pending commonly owned U.S. patent applications: "Gaming Device Having Bonus Scheme With Incremental Value Disclosure," Ser. No. 09/627,198, "GAMING DEVICE HAVING A BONUS SCHEME WITH ALTERNATIVE ENDING SEQUENCES", Ser. No. 10/160,687, "GAMING DEVICE HAVING APPARENT AND FINAL AWARDS," Ser. No. 10/269,427,.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having multiple award profiles.

BACKGROUND OF THE INVENTION

Known gaming devices include primary and secondary or bonus games that provide awards to a player when the player makes a selection. The games typically display the award after its generation. Certain games provide only a single selection and a single award. Other games enable a player to make a plurality of selections and accumulate awards. Still further games enable a player to select to risk or exchange awards in an effort to maximize the player's ultimate award.

The games may or may not provide a sound or message associated with the award. The sounds or messages that are provided are typically the same or are selected from a limited message set each time the player wins. A credit or monetary win provides excitement and enjoyment to the player. Audio sounds or messages accompanying the credit or monetary win enhance the win and its excitement and enjoyment.

A need exists to provide a gaming device that issues awards to the player in a new and more entertaining and exciting way. A need also exists to provide more exciting and entertaining messages in connection with the award issuance.

SUMMARY OF THE INVENTION

The present invention generally provides an improved gaming device. More specifically, the present invention provides an improved gaming device having a plurality of award profiles and a library of audio messages that the gaming device uses in connection with the award profiles. Upon beginning the sequence of the present invention, the gaming device selects a group of items, such as antiques, and displays the group to the player on a display of the gaming device. The player is able to select one of the items. The game also selects and displays an actor from a plurality of actors. The actor is used to provide the audio messages of the present invention.

When the player picks one of the items, the game generates a profile, which includes a series of award increases or decreases. The profile does not determine how much the award increases or decreases; rather, the profile determines whether the award increases or decreases. Based on the known item, actor and profile, the game generates an audio script specific to the item, actor and profile. That is, a different actor would generate different script. A different item would generate a different script. A different profile would generate a different script. For each profile, actor, item combination, the game preferably stores a plurality of different scripts from which to choose. This virtually ensures that the player has different gaming experiences even if the player chooses the same item and the game chooses the same actor more than once.

After generating the script, the game generates an initial award and an award profile. The initial award is selected from a weighted or a non-weighted database. The awards of the award profile are also selected from weighted or non-weighted databases. The databases for the awards are selected based upon whether the profile increases or decreases the initial or subsequent award. That is, the same award profile is likely to yield different award outcomes. Knowing the initial award and the awards of the award profile, the gaming device is able to present a video display, which the audio script accompanies.

The game introduces the actor, who introduces the player selected item. On the display, the item has an initial value corresponding to the initial award. The item increases or decreases in value according to the generated profile. The amount that the item increases or decreases in value corresponds to the award profile generated in accordance with the profile. The actor provides an audio explanation for each award upgrade or downgrade. Again, the same item, actor and profile likely produces a different script such as a different set of explanations regarding the award. The same item, actor and award profile also likely produces different award outcomes.

Thus, the present invention provides a gaming device including a processor, a display device, a sound card and speakers for playing an audio message, an award sequence displayed by the display device, a plurality of audio messages associated with the sequence and a selected audio message played by the speakers. The selected audio message is preferably randomly selected by the game's processor.

In one embodiment the gaming device of the present invention displays a plurality of player selectable items on the display device. The gaming device prompts the player to pick one of the items. The gaming device selects an actor (such as the image of a person) from a plurality of actors and displays the actor on the display device. The actor is adapted to visually appear to provide audio messages to the player. The game also selects an award profile from a plurality of award profiles. Each award profile includes a plurality of award reviews wherein an award either increases or decreases an initially provided or previously displayed award. The awards either increase or decrease incrementally by some value or increase or decrease absolutely and become upgraded or downgraded by some other award.

In addition to selecting an award profile, the game preferably randomly selects an initial award. For each award profile, the game then preferably randomly generates a plurality of values or awards for each award review, i.e., award increase or decrease. In an incremental value example, the game randomly generates an initial award of twenty, and then incrementally increases the award by ten, decreases the award by five and then increases the award by fifteen. In an award upgrade or downgrade example, the game generates the initial award of twenty, replaces the twenty with an award upgrade of thirty, replaces the thirty with an award downgrade of twenty-five, and upgrades the twenty-five award to forty.

The game displays a visual award sequence including the initial award and the incremental values or upgrades and downgrades generated according to the selected award profile. In association with the visual sequence, the game plays an audio script, which the game selects from a plurality of scripts stored for the item selected, the actor selected and the award profile selected. That is, for each item, actor and award profile combination, the game stores a plurality of audio scripts. In one embodiment, the audio script also includes playing a sound recording of the selected actor announcing the initial award and the incremental changes or the upgrades and downgrades.

In one display embodiment, the items include antiques and the actors include antique experts. The audio messages or scripts include the experts appraising and valuing the selected items. Based on the selected profile, the message includes the actor finding value enhancing features or value decreasing flaws for the selected item.

It is therefore an advantage of the present invention that the gaming device issues awards using an award profile selected from a plurality of award profiles.

Another advantage of the present invention is that the gaming device includes an audio message selected from a plurality of such messages, wherein the message is associated with a selected award profile.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIGS. 6A and 6B are profile tables, wherein the game generates an award profile that directs the play of the game.

FIG. 7 is a script table for the picked item and generated actor, wherein the table includes a plurality of scripts for each award profile provided to the player.

FIGS. 8A and 8B are initial award tables including awards that the present invention initially provides to the player.

FIG. 9A is an incremental value table including incremental values that the game adds or subtracts from the player's initial award according to a generated profile.

FIG. 9B is a weighted incremental value table including weighted incremental values that the game adds or subtracts from the player's initial award according to a generated award profile.

FIG. 9C is an absolute award table including absolute awards to which the game changes the player's initial award according to a generated award profile.

DETAILED DESCRIPTION OF THE INVENTION

Gaming Device and Electronics

Figure 1A:
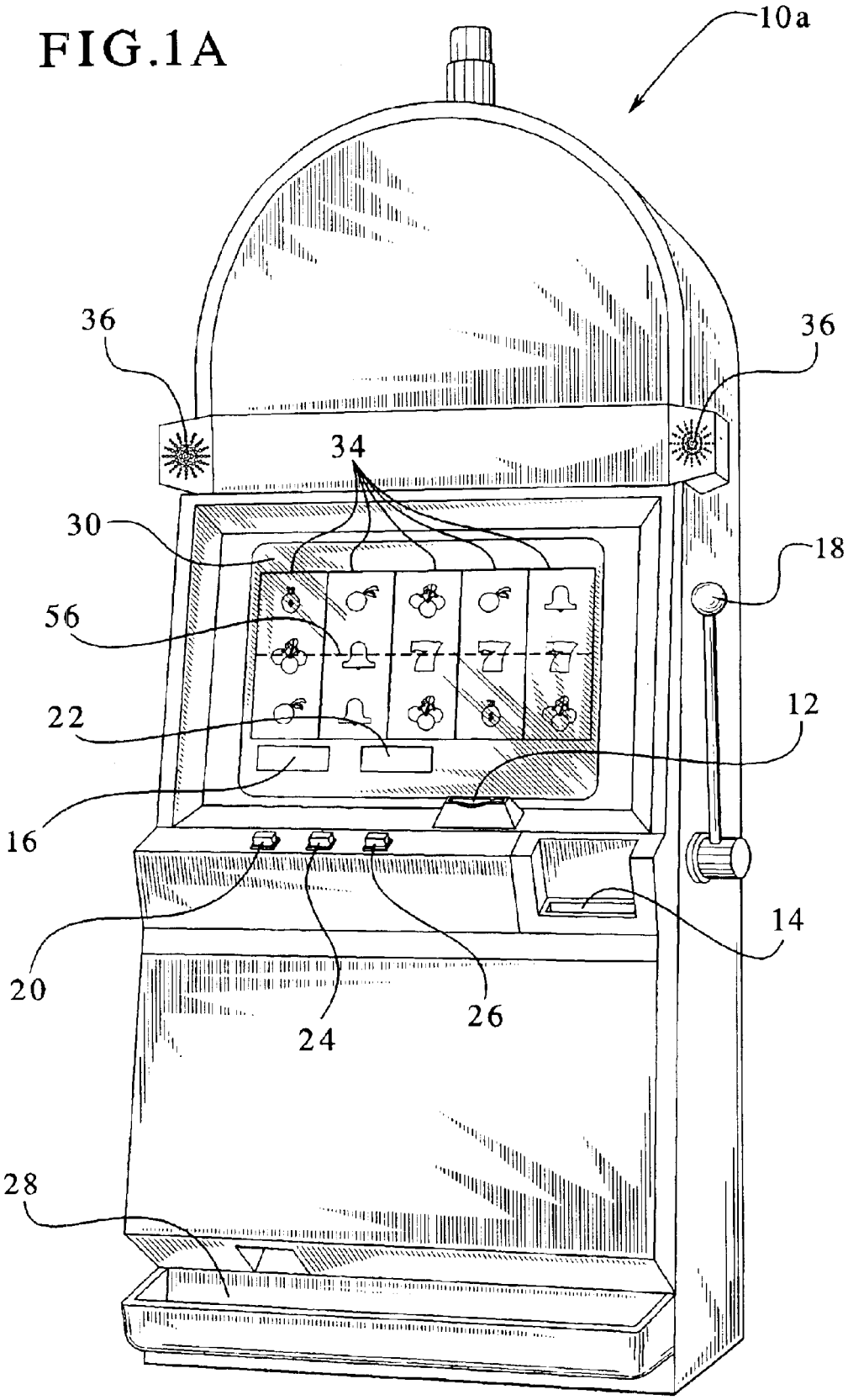
FIGS. 1A and 1B are perspective views of alternative embodiments of the gaming device of the present invention.
Figure 1B:
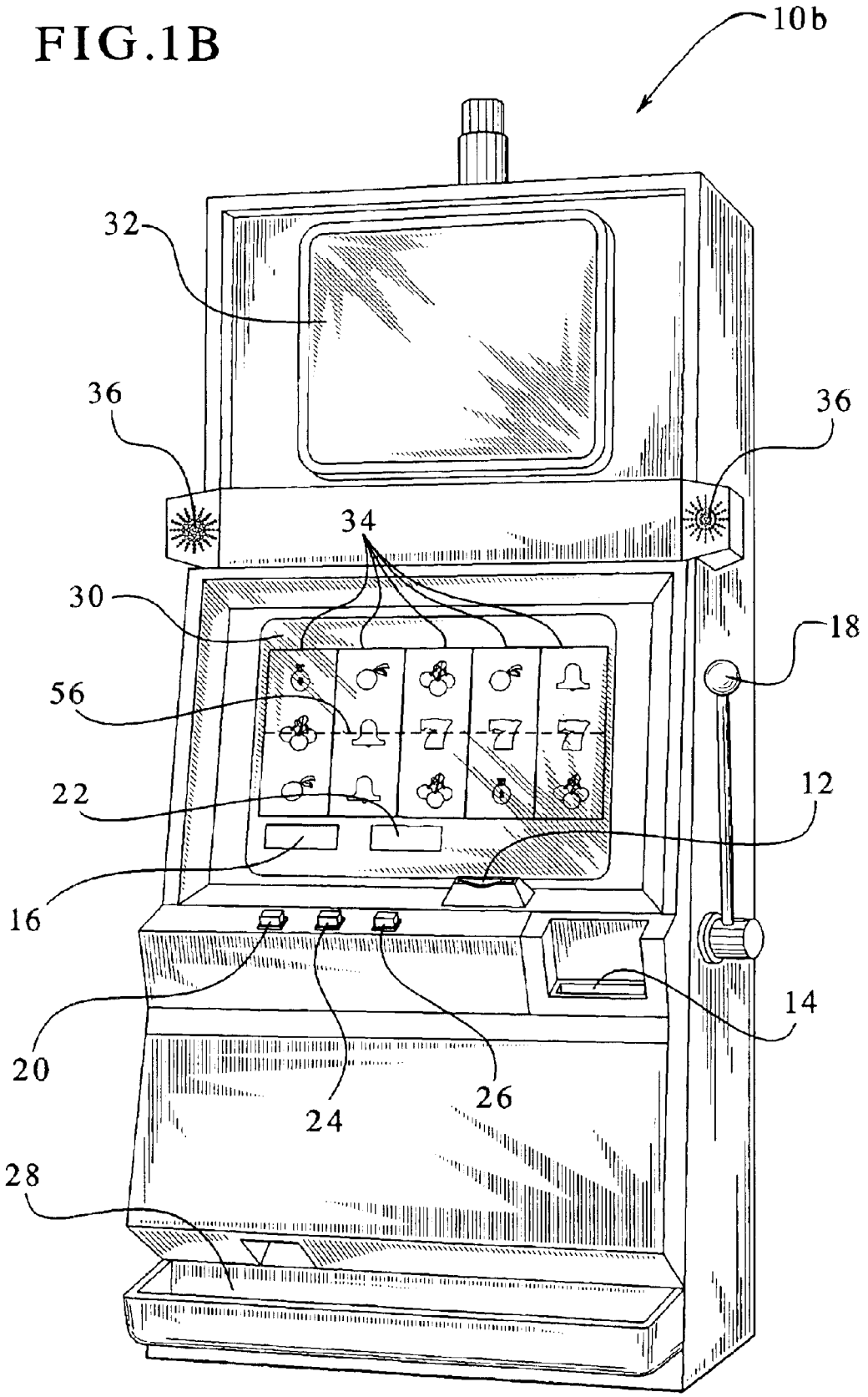

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) being a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The gaming device 10 may also embody any bonus triggering events, bonus games as well as any progressive game coordinating with these base games. The symbols and indicia used for any of the base, bonus and progressive games include mechanical, electrical or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism or apparatus. In a video poker, blackjack or other card gaming machine embodiment, the display device includes displaying one or more cards. In a keno embodiment, the display device includes displaying numbers.

The slot machine base game of gaming device 10 may display a plurality of reels 34 such as three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 2:
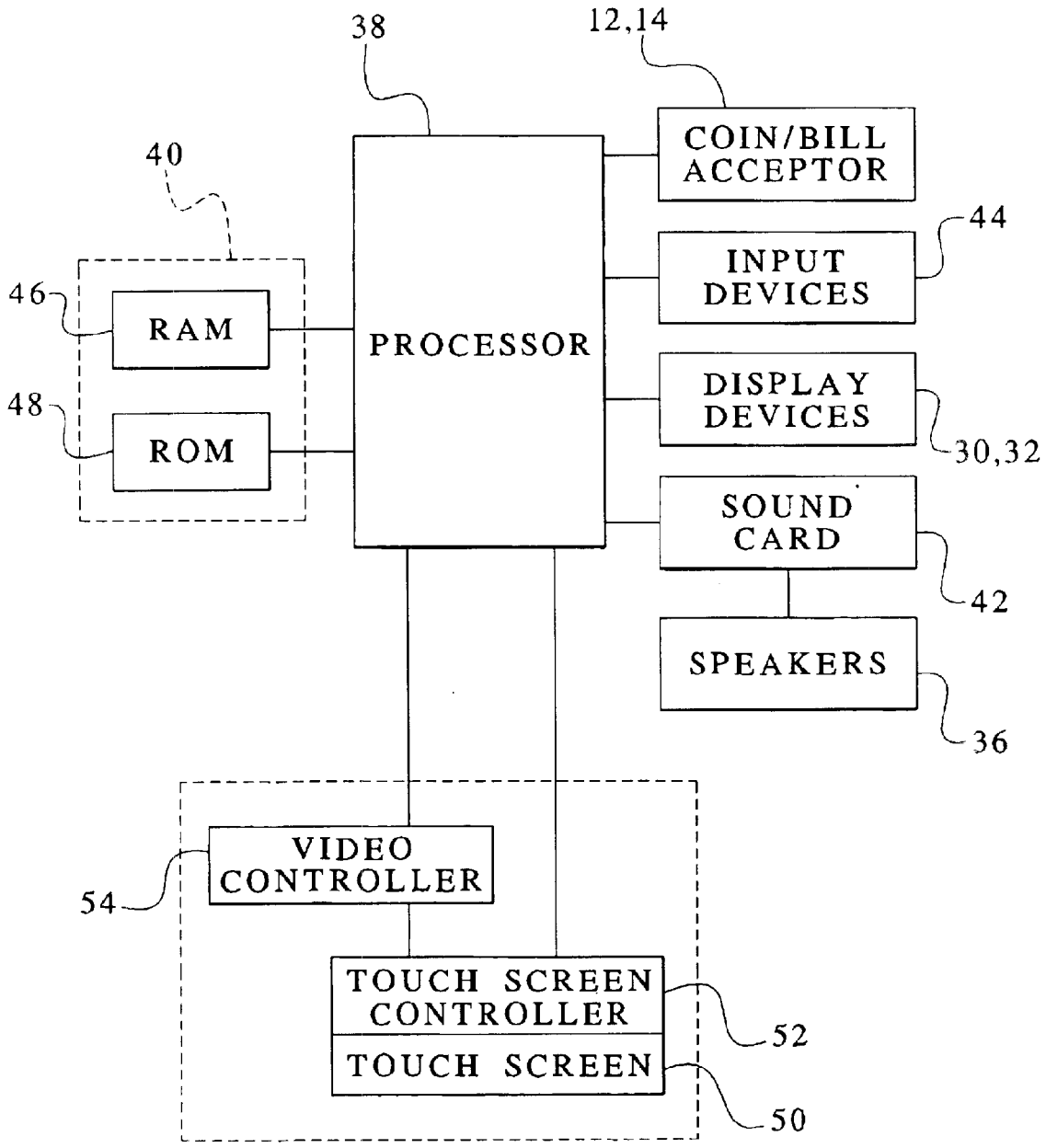
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively or alternatively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, may also include bonus games that give players the opportunity to win credits. The gaming device 10 may employ a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

General Sequence of Operation

Figure 3:
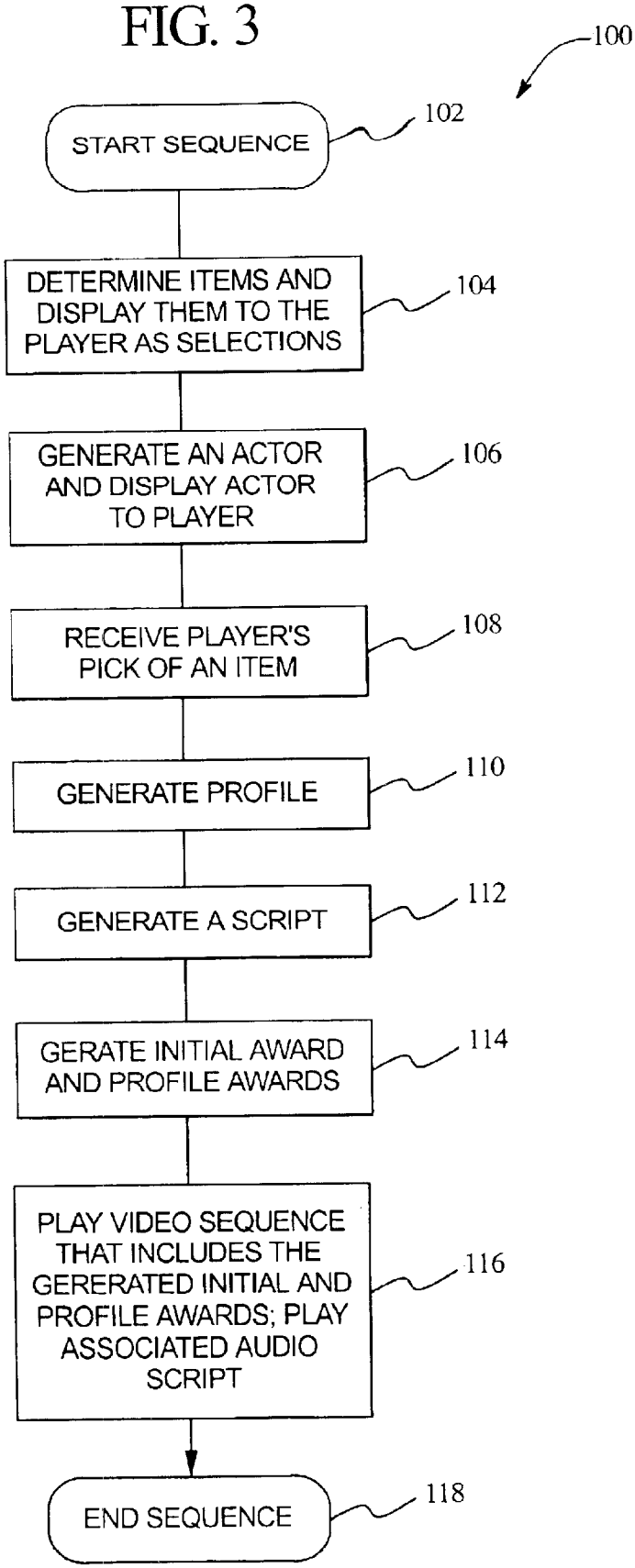
FIG. 3 is a schematic flow diagram illustrating one sequence of operation for the gaming device of the present invention.

Referring now to FIG. 3, one general sequence 100 for operating the gaming device of the present invention is illustrated. Upon a sequence triggering event, as indicated by the oval 102, the game determines or randomly generates a plurality of items from a table of items, as indicated by the block 104. In a stand alone embodiment, the sequence triggering event is the player's deposit of an appropriate amount of money and wager or initial input, e.g., in a slot embodiment pulling arm 18 or pushing play button 20 (see FIGS. 1 and 2). In a bonus game embodiment, the sequence triggering event is the player's achievement of a qualifying condition such as receiving a predetermined combination of symbols along a payline 56 (see FIGS. 1 and 2). A table of items is discussed below. The present invention is applicable to many display embodiments. In one example display embodiment, the items are antiques. The item table is therefore a table of antiques. The game preferably randomly generates a plurality of the items and displays the items to the player as selections, as indicated by the block 104.

In one example embodiment, the gaming device generates an actor from a plurality of actors and displays the actor to the player as indicated by the block 106. A table of actors is also described below. The present invention stores a plurality of audio messages or scripts for each actor and for each award profile described below. When the game generates an actor, the game sets one of the parameters that leads to the audio display that the game provides to the player. In an alternative embodiment, the game includes enabling the player to pick an actor from a plurality of selectable actors displayed to the player.

Upon receiving a player's pick of an item, as indicated by the block 108, the game generates an award profile or a profile, as indicated by the bock 110. The present invention contemplates any input device for enabling the player to pick an item. Preferably, the game provides a touch screen 50 (FIG. 2) in connection with the video monitor, which enables the player to simply touch or press the desired item displayed on the video monitor. The game's generation of an actor and the player's pick of an item provides the game with the parameters necessary for the game to generate a profile. The present invention contemplates non-weighted and weighted profile tables as discussed below.

The profiles direct the award generation leading to the player's ultimate award. The profiles also provide one of the parameters necessary for the game to generate a script. Once the gaming device knows the item picked by the player, the actor generated by the gaming device and the profile generated by the gaming device, the gaming device generates an audio message or script for the situation, as indicated by the block 112. The gaming device stores a plurality of scripts for each scenario, such that two games having the same item, the same actor and the same profile are able to generate different scripts and thus a different gaming experience for the player.

The gaming device generates an initial award and award profile, which lead to the ultimate award that the gaming device provides to the player, as indicated by the block 114. The gaming device preferably generates an initial award from one of the non-weighted or weighted tables discussed below. The gaming device preferably generates an initial award independent of the item, actor or profile. Alternatively, the gaming device stores different initial award tables for one or more of these variables.

The gaming device includes a plurality of award profile tables discussed below. One table includes incremental values that the gaming device adds or subtracts from the initial award per the generated profile. Another table includes weighted incremental values that the gaming device adds or subtracts from the initial award per the generated profile. A further table includes absolute awards to which the gaming device changes the initial award per the generated profile.

The gaming device plays the audio message or script, preferably with an accompanying video display sequence, wherein the video display sequence incorporates the generated initial award and the award profile, as indicated by the block 116. The gaming device alternatively includes incorporating into the audio message or script, an audio recording of a voice announcing the initial and the award profile. The outcome of the script and display is the player's ultimate award, which the gaming device provides to the player. The sequence 100 ends, as indicated by the oval 118.

Tables

Figure 4:
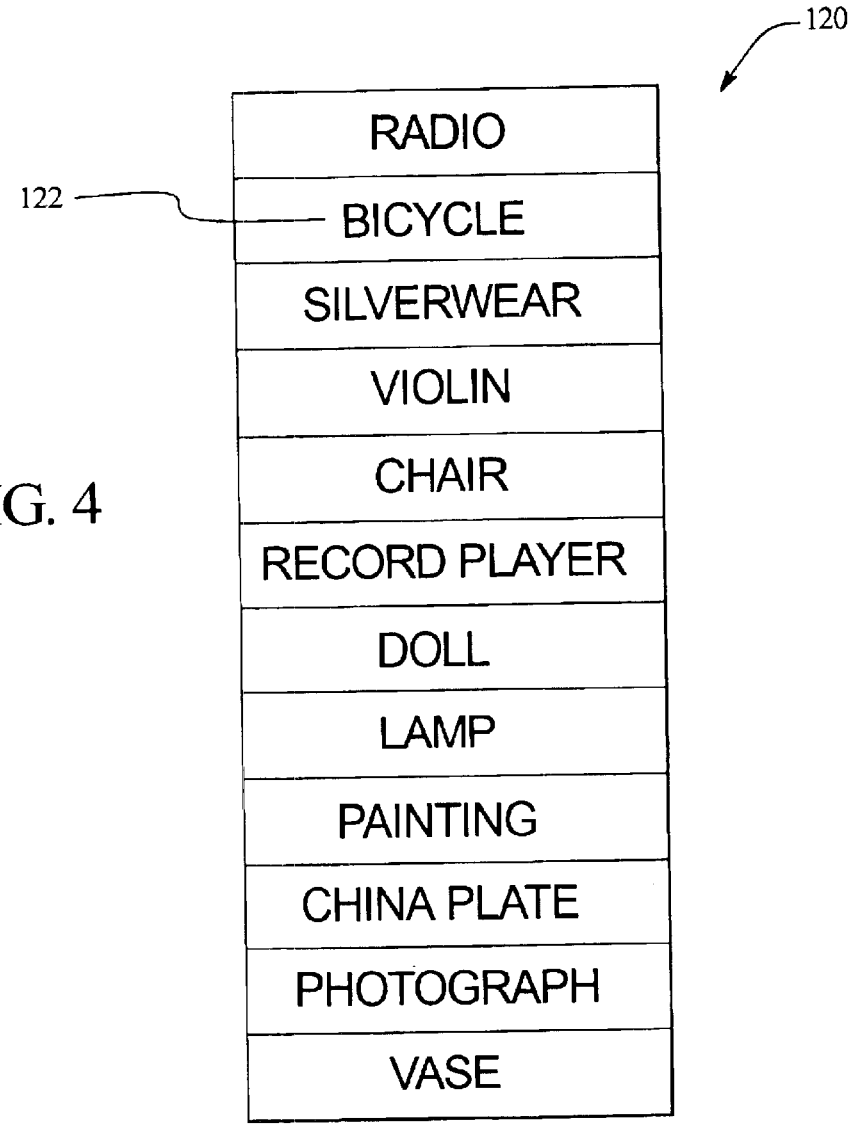
FIG. 4 is a table including a set of items, a plurality of which the present invention generates and presents to the player, wherein the player picks one item for game play.

Referring now to FIG. 4, an item table 120 includes a set of items 122. The present invention contemplates an item being any displayable or describable thing such as a physical object, place, idea or story. The items preferably suitably enable an actor of the gaming device to attach a money or credit value to the items. Thus, the items preferably have or can have a value. In one display embodiment, the items are antiques. The item table is therefore a table of antiques such as dolls or vases, and includes having any antique desired by the implementor. The item table 120 displays twelve items 122 but alternatively includes having any number of items 122, such as fifty or one hundred.

The present invention preferably generates or selects two or more and preferably five of the items 122 and presents the generated items to the player as selections on one of the display devices 30 or 32 (FIGS. 1A and 1B), which is preferably a video monitor having a touch screen 50 (FIG. 2). As illustrated below, the selections or items 122 that the gaming device generates and the selection or item 122 that the player picks for gaming device play preferably do not affect the player's ultimate award. The table 120 is preferably therefore not weighted. That is, there is an equal likelihood that the gaming device generates any one of the items 122.

Figure 5:
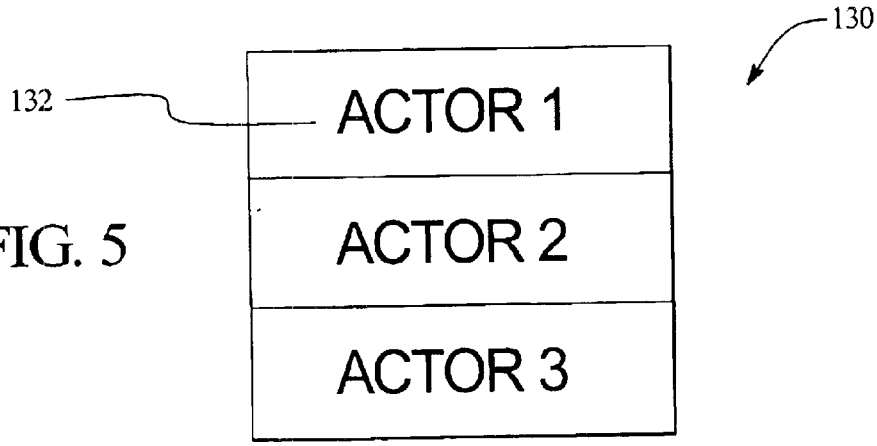
FIG. 5 is a table including a set of actors, wherein the game generates and presents an actor to the player.

Referring now to FIG. 5, an actor table 130 includes a plurality of actors 132. The actors are displayed to the player in conjunction with an audio message conveyed or presented to the player. In one example, the actors are antique experts or specialists. The actor table 130 includes having different antique experts to graphically display to the player. The table 130 is shown having three actors 132, but alternatively includes having any number of actors 132.

The present invention preferably generates one of the actors 132 and presents the generated actor to the player on one of the display devices 30 or 32 (FIGS. 1A and 1B), which is preferably a video monitor. As illustrated below, the actor 132 that the gaming device generates preferably does not affect the player's ultimate award. The table 130 is preferably therefore not weighted. That is, there is an equal likelihood that the gaming device generates any one of the actors 132. It should be appreciated that the actors could also be selected by the player.

The actor 132 that the gaming device generates preferably does affect the audio message or script that the gaming device plays during the game. In the preferred antique display embodiment, the present invention preferably includes recording and storing actual people and preferably actual antique experts critiquing or valuing the antiques or items 122 that the gaming device presents and that the player picks. When the player picks an item and the gaming device generates an actor, the gaming device generates an audio message or script of an actual person associated with the generated actor who evaluates the picked item.

Referring now to FIG. 6A, an award profile or a profile table 140, includes a plurality of award profiles 142, each having a different set of reviews 144. The profile table 140 includes three reviews 144 but alternatively may include having any number of reviews. A review is generally a segment of the audio message or script in which the player's award changes. If there are three reviews, there is preferably three award changes. In each profile 142, a review 144 includes the value of an initial award either increasing ("up") or decreasing ("down"). In profile #1, therefore, the player's initial award is increased three times during the audio message or script provided by the generated actor for the picked item. In the profile #3, the initial award goes up, then down and then down again.

If there are three reviews 144 performed by the actors on an item, there are eight possible award profiles 142 as displayed in the profile table 144. The present invention includes providing less than all possible award profiles for the given number of reviews as desired by the implementor. The present invention also contemplates enabling an award to stay the same value in a review 144, which would present a third possibility and increase the number of possible profiles to twenty-seven. It should be appreciated that increasing the number of reviews 144 increases the possible number of award profiles 142.

Referring now to FIG. 6B, a weighted profile table 150 includes the award profiles 142 and reviews 144 of FIG. 6A as well as a likelihood of generation percentage 152. It should be appreciated that the profile 142 that the gaming device generates likely affects the player's ultimate award. The present invention therefore includes providing a weighted profile table 150 that enables the implementor to have at least one profile 142 generated more often than at least one other profile 142. In one embodiment, the table 150 includes a bell shaped generation distribution wherein profiles four and five are more likely to be generated than the profiles three and six, which are more likely to be generated than the profiles two and seven, which are more likely to be generated than profiles one and eight. The gaming device includes having any generation distribution desired by the implementor. The generation percentages 152 preferably equal one hundred percent.

Referring now to FIG. 7, a script table 160 for a player picked item and a gaming device generated expert includes a plurality of audio messages or scripts 162 for each award profile 142. Although each profile 142 includes three scripts A, B and C, the present invention includes providing any number of scripts 162 per profile 142 and different numbers of scripts for different profiles 142. The present invention includes providing a number of tables, such as table 160, equal to the number of items 122 (twelve in FIG. 4) multiplied by the number of actors 132 (three in FIG. 5) or thirty-six using FIGS. 4 and 5. It should be appreciated that from the disclosure contained herein, one skilled in the art can devise different tables for organizing the scripts, such as by actor and profile, whereby the table orders the scripts for each item. Likewise, the present invention includes organizing the scripts by item and profile, whereby the table orders the scripts for each actor.

In any organizational case, the total number of scripts 162 equals the number of items 122 (twelve in FIG. 4) multiplied by the number of actors 132 (three in FIG. 5) multiplied by the number of profiles 142 (eight in FIGS. 6A and 6B) multiplied by the number of scripts per profile/per actor/per item (three scripts per profile in FIG. 7) or 864 messages using FIGS. 4, 5, 6A or 6B and 7. That is, for the example discussed above, the present invention contemplates storing eight hundred sixty-four discrete audio messages or scripts 162 in memory and recalling and playing the appropriate message according to the parameters herein described.

FIG. 7 illustrates that the gaming device plays different audio messages or scripts 162 under exactly the same circumstances. Therefore, a player who picks the same item 122 and draws the same actor 132 and the same award profile 142 likely hears a different script 162. To encourage this type of varied game play, the gaming device preferably does not weight the script table 160 or otherwise make any script more likely to be generated than any other script.

Referring now to FIG. 8A, an initial award table 180 includes a plurality of initial awards 182. The initial awards are the initially provided awards that the award profiles 142 either increase or decrease. The initial award table 180 provides the awards 182 twenty through fifty and alternatively provides any number of and value of initial awards 182. The awards of the present invention include game credits, a game credit modifier such as a multiplier that multiplies a number of gaming device credits such as a bet, a total win, a payline 56 (FIGS. 1A and 1B) win etc. The awards also represent other items of value such as a number of picks from a prize pool. In one embodiment, the initial awards 182 of the initial award table 180 are all equally weighted, so that gaming device 10 is equally likely to select any initial award twenty through fifty.

Referring now to FIG. 8B, a weighted profile table 190 includes a portion of the initial awards 182 of FIG. 8A, each award 182 including an associated likelihood of generation percentage 152. It should be appreciated that the initial award 182 that the game generates likely affects the player's ultimate award. The present invention therefore contemplates providing a weighted initial award table 190 that enables the implementor to have at least one initial award 182 generated more often than at least one other initial award. The table 190 includes a bell shaped generation distribution wherein the middle four initial awards 182 (i.e., 32, 34, 36 and 38) are twice as likely to be generated as any other award of the table 190. The gaming device includes having any generation distribution that satisfies the game math. The generation percentages 152 again preferably add to one hundred percent. The initial award could otherwise be randomly determined.

Referring now to FIG. 9A, an incremental value table 200 includes incremental values 202 that the gaming device adds or subtracts from the player's initial award (not illustrated) according to a generated profile 142. Each review 144 of each profile includes a plurality of values 202, one of which gaming device 10 generates for each review 144. The table 200 includes four values 202 to choose from for each review 144, alternatively includes any number of values 202 to choose from for each review 144 and further alternatively includes a different number of values 202 to choose from in different reviews 144. The gaming device provides any different values and is not limited to the values as illustrated. In FIG. 9A, the gaming device is equally likely to generate any value included for a particular review 144 of a particular award profile 142.

In one example for profile #1 which is up, up, up in FIG. 6A, the game randomly generates the values +15, +5 and +50 from Review 1, Review 2 and Review 3, respectively. The game eventually adds seventy to the initial award 182 generated from either table 180 or 182 of FIGS. 8A or 8B to form the ultimate award provided to the player. In profile #3 which is up, down, down in FIG. 6A, the game includes randomly generating the values +10, −5 and −10 from Review 1, Review 2 and Review 3, respectively. The game therefore subtracts five from the initial award 182 generated from either table 180 or 182 of FIGS. 8A or 8B.

In both a stand alone or bonus embodiment of the present invention, the game is preferably enabled to generate a positive, zero or negative overall profile value. In a stand alone embodiment, however, the game is preferably enabled to generate a zero but not a negative overall award, which is provided to the player (i.e., initial award +/− profile value). That is, gaming device 10 does not require the player to owe money to the gaming device. Further, in a bonus round embodiment, the game is preferably not enabled to generate a zero or a negative overall award provided to the player (i.e., initial award +/− profile value).

Referring now to FIG. 9B, a weighted profile table 210 includes the incremental values 202 of FIG. 9A, wherein each value 202 has an associated likelihood of generation percentage 152. The incremental values 202 that the game generates likely affect the player's ultimate award. In one embodiment, a weighted initial award table 210 is provided in which at least one incremental value 202 is generated more often than at least one other incremental value 202.

The table 210 includes a plurality of different generation distributions and generally distributes the likelihood percentage so that the intermediate values are more likely to be generated than the highest or lowest values. The gaming device can have any suitable generation distribution desired by the game implementor. The generation percentages 152 for each review 144 of each profile 142 equal one hundred percent.

Referring now to FIG. 9C, an absolute value table 220 includes absolute awards 204 to which the gaming device changes the player's initial award 182 (FIGS. 8A and 8B) according to a generated profile 142. Each review 144 of each profile includes a plurality of awards 204, one of which the gaming device generates for each review 144. The table 220 includes four awards 204 to choose from for each review 144, alternatively includes any number of awards 204 to choose from for each review 144 and further alternatively includes a different number of awards 204 to choose from in different reviews 144. The gaming device can provide any different awards and is not limited to the awards as illustrated. The implementor may include any suitable award. FIG. 9C equally weights each award and alternatively unequally weights the awards in a manner similar to that as shown in FIG. 9B.

In one example for profile #1 which is up, up, up in FIG. 6A, the gaming device includes randomly replaces the awards to, 55, 90 and 115 from Review 1, Review 2 and Review 3, respectively. The gaming device therefore replaces the initial award 182 generated from either table 180 or 182 to 55, replaces 55 with 90 and replaces 90 with 115. In profile #3 which is up, down, down in FIG. 6A, the gaming device randomly generates the awards, e.g., 100, 55 and 49 from Review 1, Review 2 and Review 3, respectively. The gaming device therefore replaces the initial award with 100, replaces 100 with 55 and replaces 55 with 49.

In both a stand alone or bonus embodiment of the present invention, the gaming device is preferably enabled to generate a positive, zero or negative overall profile award. In a stand alone embodiment, however, the gaming device is preferably enabled to generate a zero but not a negative overall award, which is provided to the player (i.e., initial award replaced by profile awards). Further, in a bonus round embodiment, the game is preferably not enabled to generate a zero or a negative overall award provided to the player (i.e., initial award replaced by profile awards).

Either of the incremental value tables 200 and 210 of FIGS. 9A and 9B, respectively, or the absolute value table 220 of FIG. 9C may be configured alternatively without the positive or negative signs. That is, in another embodiment, a table is provided not according to the profiles #1 to #8 but without positive or negative signs. Gaming device 10 generates a value either according to a profile or otherwise and then independently generates whether the value is positive or negative, i.e., an award increase or decrease.

Gaming device 10 can generate whether the value is positive or negative before or after the value is generated. For example, gaming device 10 can generate one of the award profiles of FIGS. 6A to 6B to provide the position/negative parameter and then generate a number of values from a separate pool. For example, if gaming device 10 generates profile #6 of down, up, down, and then generates three values such as ten, five and twenty, gaming device 10 then decreases the award using the ten value, increases the award using the five value and increases the award using the twenty value. The values can be used on an incremental or absolute basis as described herein.

Further alternatively, gaming device 10 can randomly choose a value from a pool and randomly determine whether to use the value to increase or decrease the player's award (in either an incremental or absolute manner). Here, the award profile, in retrospect, is randomly determined as opposed to being predetermined per FIGS. 6A, 6B, 9A, 9B and 9C.

Figure 10A:
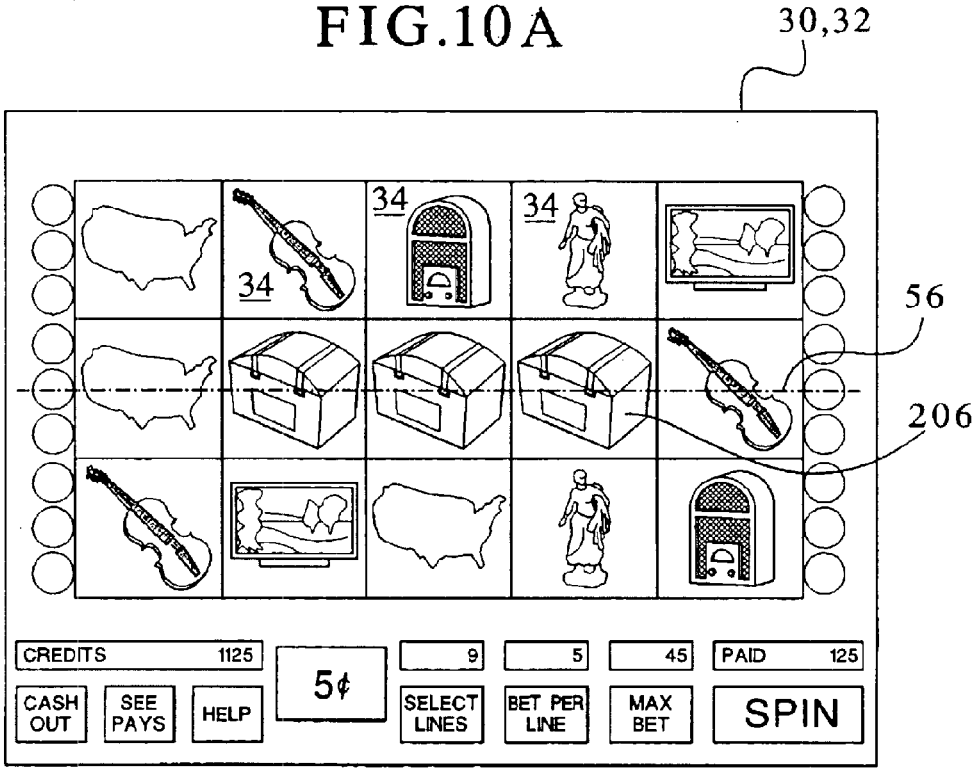
FIGS. 10A through 10I are front elevational views of one of the display devices of FIGS. 1A and 1B illustrating one display embodiment of the present invention.

Referring now to FIGS. 10A through 10I, one of the display devices 30 or 32 includes one preferred display embodiment having an antique evaluation. The antique evaluation embodiment includes being a bonus round of a slot machine. FIG. 10A illustrates that the simulated slot machine reels 34 (FIGS. 1A and 1B) display three bonus symbols 206 along a single payline 56. The three bonus symbols 206 trigger a bonus round embodiment of the present invention.

Figure 10B:
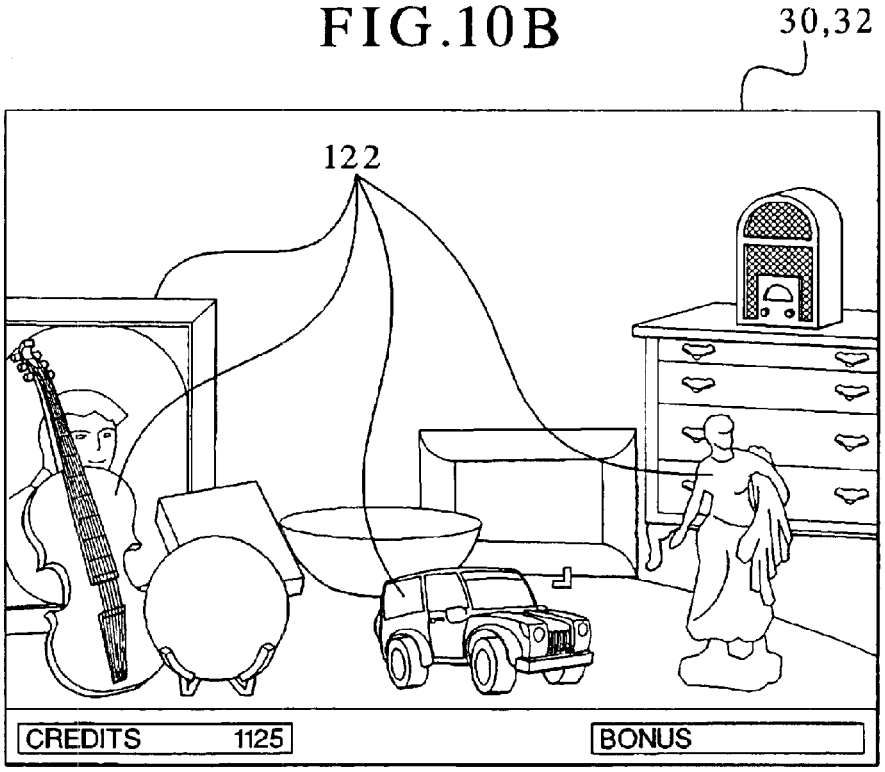

Referring to FIG. 10B, the gaming device preferably randomly generates a plurality of items 122 from a table such as the table 120 of FIG. 4, wherein the items are preferably antiques, and displays the items 122 to the player as selectable areas of a touch screen 50 having an associated touch screen controller 52 (FIGS. 1A and 1B). Each antique is thus a separate area of the touch screen 50 adapted to send a discrete input to the controller upon the player's touching or pressing of the area. Alternatively, the gaming device includes displaying the antiques on a video monitor display device 30 or 32 with identifying indicia (not illustrated), such as "A," "B," "C," etc. and including a separate electromechanical input device 44 (FIG. 2) for each indicia. The player picks an antique A by pressing the electromechanical input device displaying the "A" indicia.

Figure 10C:
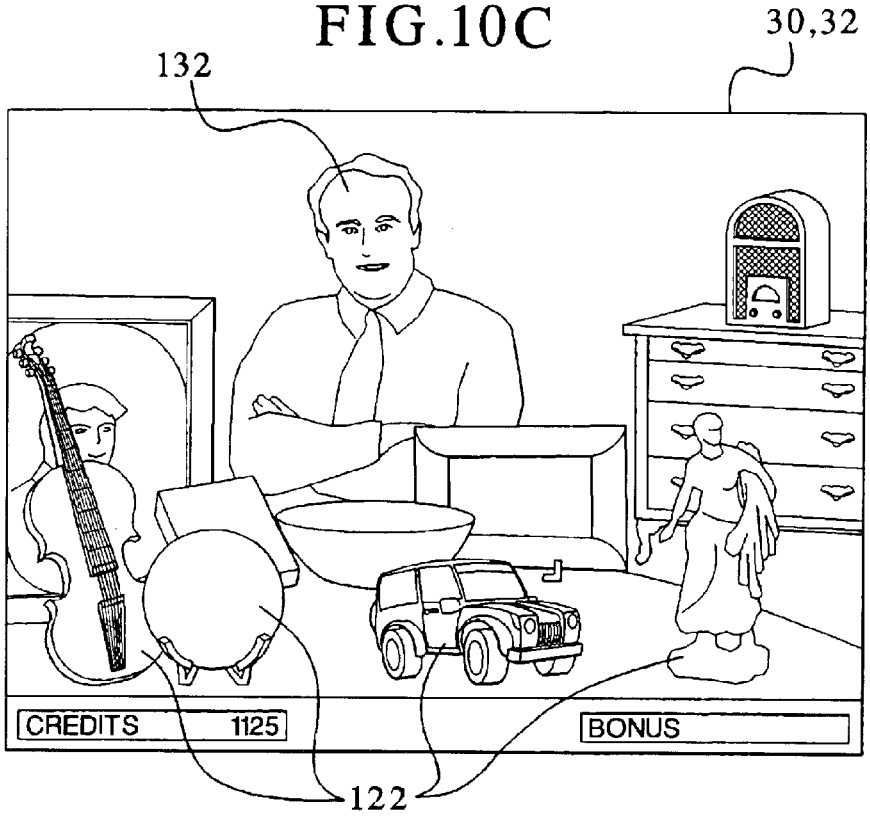
Figure 10D:
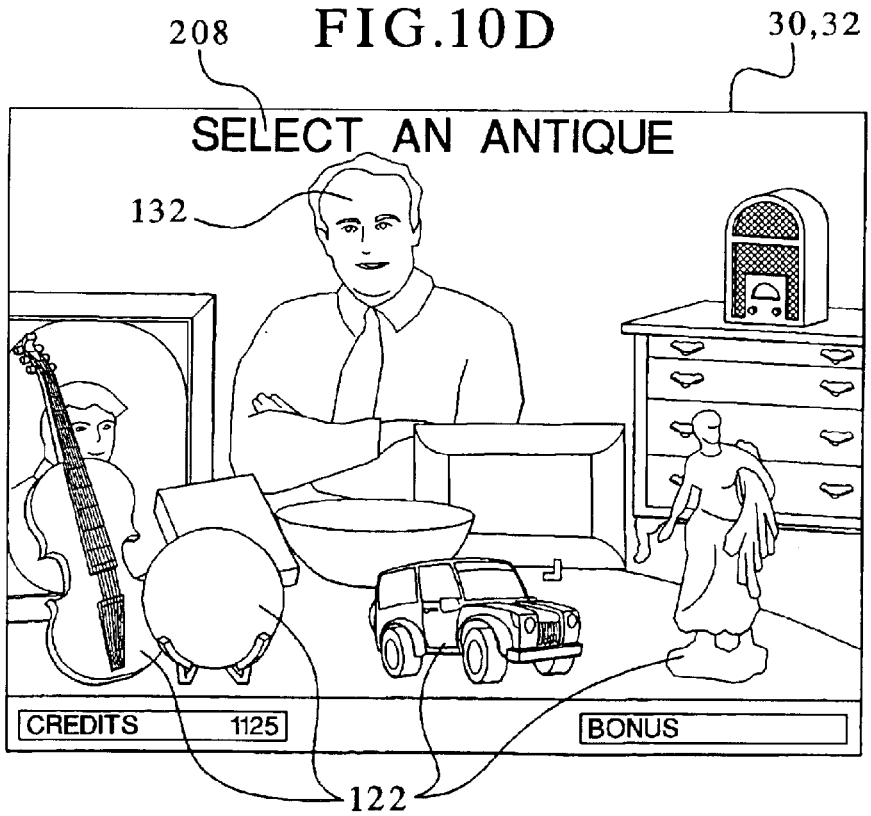

Referring now to FIG. 10C, the gaming device generates an actor 132 from a table such as the table 130 of FIG. 5 and displays the actor 132 to the player. The gaming device includes storing an introductory audio message for each actor 132, whereby the actor introduces himself or herself and the antique evaluation sequence of the game. In FIG. 10D, the gaming device prompts the player through a suitable audio and/or visual message 208 to pick an item 122 or antique. The message includes being recorded by the selected actor 132.

Figure 10E:
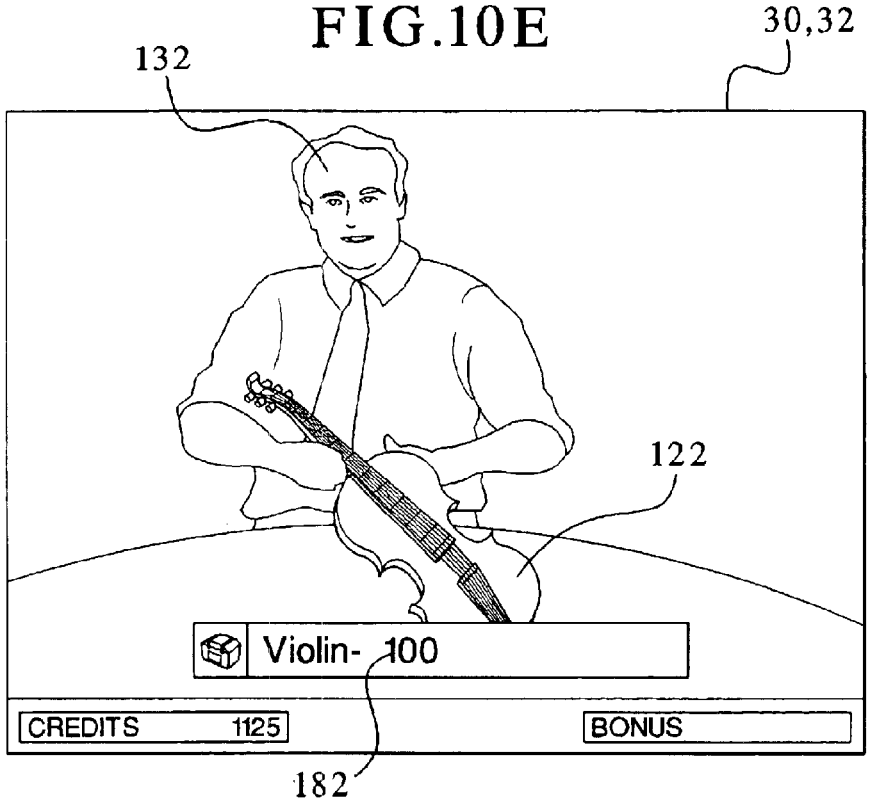

Referring now to FIG. 10E, the display device 30 or 32 illustrates that the player chooses the violin item 122. The gaming device preferably randomly generates an award profile (not illustrated) such as from the database 140 or 150 of FIGS. 6A and 6B. In this example, the gaming device generates the profile #4 of up, down and up. The gaming device then preferably randomly generates an initial award 182 such as from a table such as the table 150 of FIG. 7. The gaming device displays the initial award of one hundred to the player and preferably provides a suitable audio message recorded by the selected actor 132 for the picked item 122, which introduces the item 122 and alternatively annunciates the initial award 182.

Figure 10F:
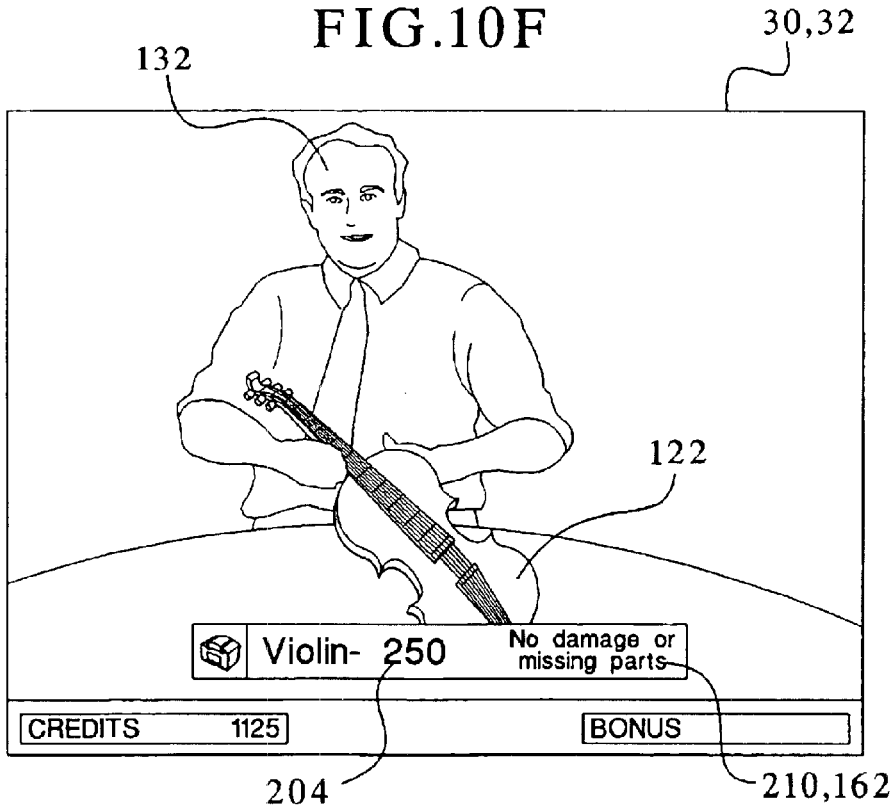

Referring now to FIG. 10F, the display device 30 or 32 illustrates the first review 144 of the profile #4, which is a value increase or upgrade. The gaming device displays, as part of a visual award sequence, the actual award 204 of two hundred fifty. Gaming device 10 can use an incremental award 202 when employing an incremental value table, such as tables 200 and 210 of FIGS. 9A and 9B or an absolute award 204 from an absolute award table, such as the table 220 on FIG. 9C. That is, the gaming device includes generating an incremental value 202 of positive one hundred fifty, adding the value to the initial award 182, and displaying the absolute award of two hundred fifty, as illustrated in FIG. 10F. Gaming device 10 alternatively displays the incremental value 202. For instance, the display instead includes the visual message 210, as part of a visual sequence that states, "increase value by 150 because of no damage or missing parts." Further alternatively, and as used in connection with FIGS. 10F to 10I, gaming device 10 generates and displays a new and absolute value 204.

Gaming device 10 generates an audio script 162 that mirrors the visual message 210, which is recorded by the selected actor 132 for the picked item 182. The script explains the increase or decrease for the particular review 144 of the selected profile 142. As illustrated in FIG. 10F, the actor explains that no damage or missing parts to the item 122 justifies a value increase of one hundred fifty or award upgrade to two hundred fifty. The audio message includes or does not include a recording of the actual value increase or actual award upgrade or downgrade as described in more detail below.

The message includes being generic such as "no missing parts on the violin increases its value." Alternatively, the gaming device includes recording a voice announcing, the value change or the upgraded award and providing a specific message, including an item component such as "the violin increases in value because of no missing parts," and an additional value or award component such as "to two hundred fifty." This embodiment requires a separate database (not illustrated) of recorded awards and value increases for each actor. It should be appreciated that the messages could be computer generated and not simply recorded messages. Further alternatively, the messages could be computer generated, computer enhanced or modified voice recordings.

Figure 10G:
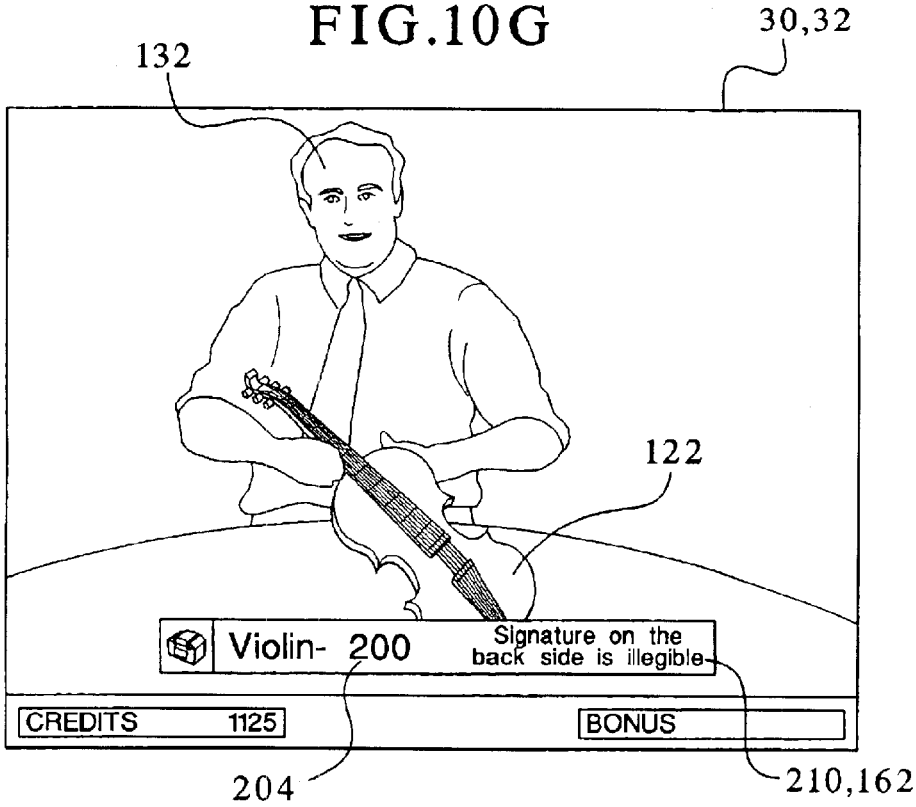

Referring now to FIG. 10G, the display device 30 or 32 illustrates the second review 144 of the profile #4, which is a value decrease or award downgrade. The gaming device displays a visual message 210 as part of a visual sequence that states, "signature on back side is illegible." The gaming device generates an associated audio script 162 such as from the script table 160, recorded by the selected actor 132 for the picked item 182, which explains the decrease for the second review 144 of profile #4. As indicated in FIG. 10G, the actor audibly explains that an illegible signature on the back side of the violin or item 122 causes a value decrease or award downgrade. As above, the audio explanation includes being generic or specific. If specific, the audio explanation also preferably includes that the value decreases by fifty or downgrades to a value of two hundred.

Figure 10H:
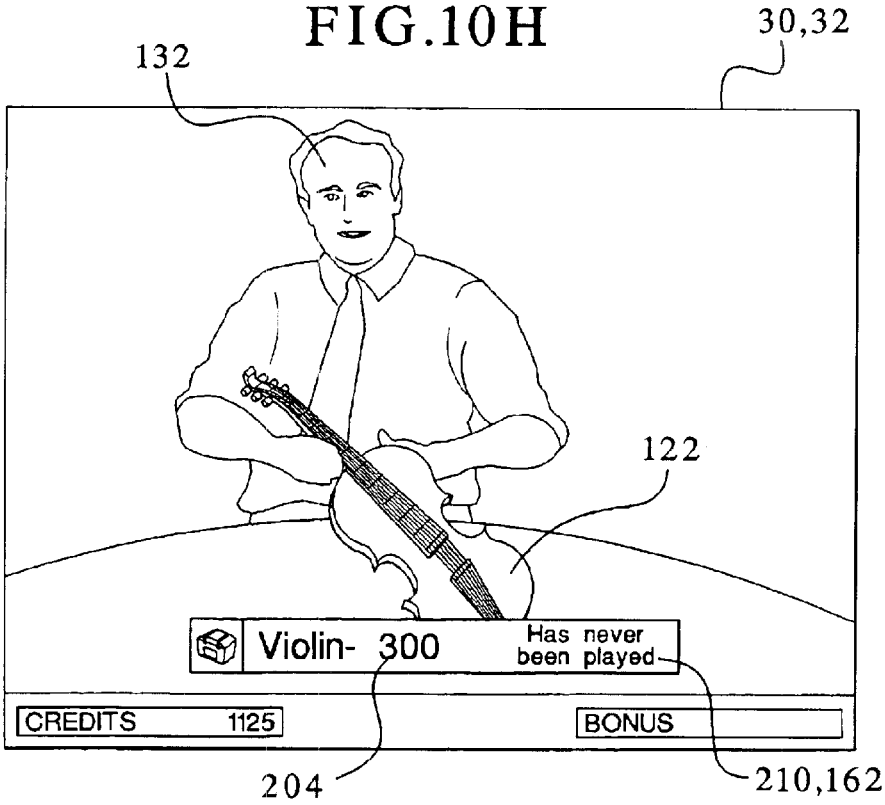

Referring to FIG. 10H, the gaming device generates a visual message 210 and an associated audio script 162 recorded by the selected actor 132 for the third review 144 of the profile #4 and the selected item 122, which includes a value increase or award upgrade. In FIG. 10H, the actor 132 explains that the violin or item's previous non-use justifies a value increase or award upgrade. As above, the explanation includes being generic or specific. If specific, the audio message additionally includes that the value increases by one hundred or upgrades to three hundred.

Figure 10I:
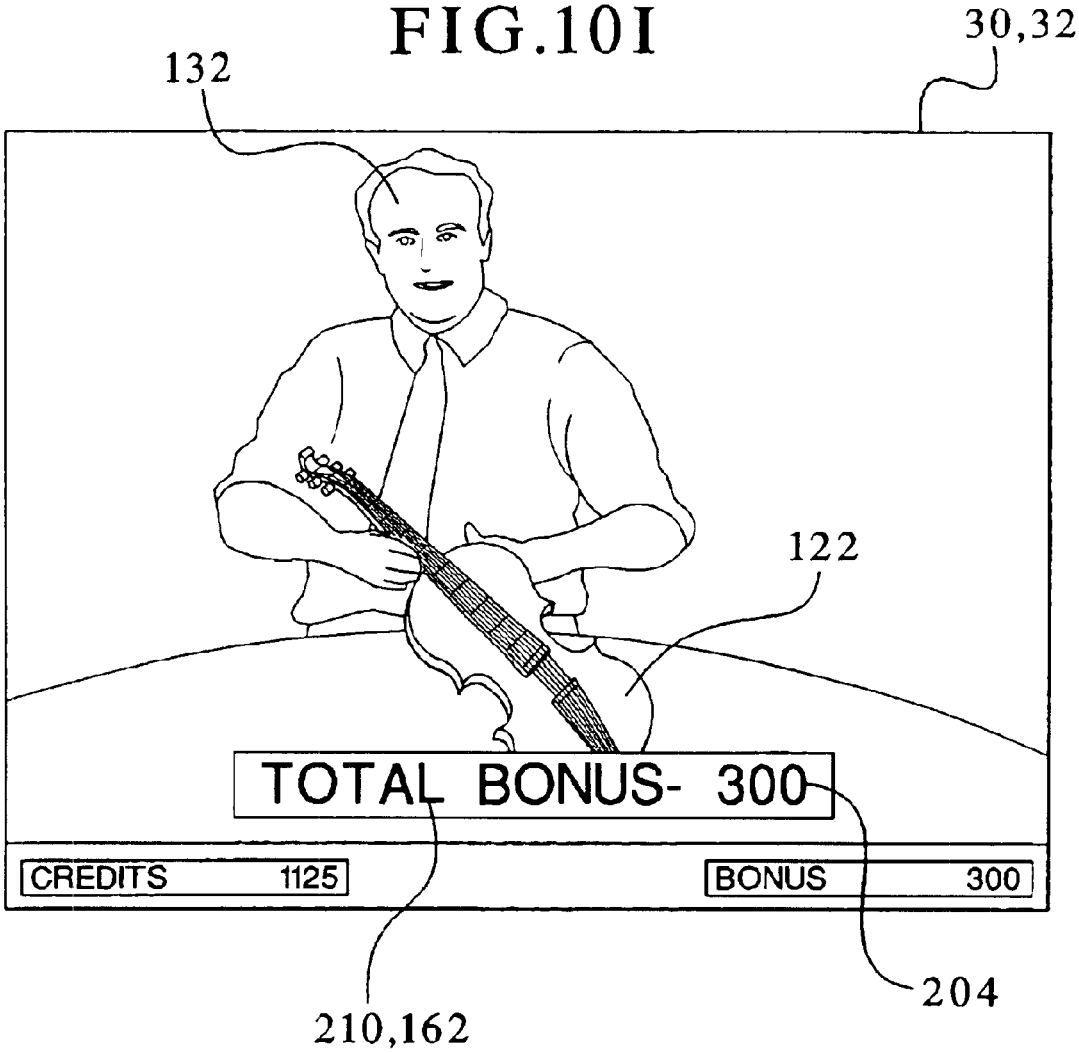

FIG. 10I illustrates that the gaming device provides a suitable video message 210 indicating that the game provides an ultimate award of three hundred credits to the player. The message is preferably accompanied by an associated audio script 162. The script 162 includes being recorded by the actor 132 and being generic, such as, "So here's the final value of the violin." Alternatively, the script 162 is specific, such as, "So, the final value of the violin you selected in my opinion is 300." In the specific script 162 alternative, the game in one embodiment includes storing the recording of the final generated award 204 whereby the game plays back a generic message, "So, the final value of the violin you selected in my opinion," followed by the specific message "is 300."

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a processor;

a display device controlled by the processor; and a plurality of award profiles stored in a memory device accessible by the processor, each award profile including a predetermined number of award changes, wherein the number is at least two, wherein at least one of said award changes of at least one of the award profiles includes an award decrease, and wherein the processor: (i) selects one of the award profiles; (ii) causes the display device to display the award changes of the selected award profile; and (iii) provides an award to a player based on the selected award profile.

2. The gaming device of claim 1, wherein the award changes of the award profiles include incremental value changes stored in the memory device.

3. The gaming device of claim 1, wherein the award changes of the award profiles include fixed award upgrades and award downgrades.

4. The gaming device of claim 1, wherein the award changes of the award profiles include randomly determined award upgrades and award downgrades.

5. The gaming device of claim 1, which includes an audio message associated with each award change of the selected award profile.

6. The gaming device of claim 5, wherein the audio messages include human voice recordings.

7. The gaming device of claim 5, which includes a plurality of selectable items displayed by said display device, wherein the audio messages are based on the selectable items.

8. The gaming device of claim 5, which includes an actor displayed by said display device, wherein the audio messages are associated with said displayed actor.

9. The gaming device of claim 5, wherein the award provided to the player is based on a result of a final award change of the selected award profile.

10. A gaming device comprising:

a processor;

a display device controlled by the processor;

a plurality of award profiles stored in a memory device accessible by the processor, each award profile including a predetermined number of award changes, wherein the number is at least two, wherein at least one of said award changes of one of the award profiles includes an award decrease, and wherein the processor: (i) selects one of the award profiles; (ii) causes the display device to display the award changes of the selected award profile; and (iii) provides an award to the player based on the selected award profile;

an actor displayed by the display device, the actor performing an action associated with each of the award changes of the selected award profile; and an audio message associated with at least one of the award changes.

11. The gaming device of claim 10, wherein the processor selects the actor from a plurality of actors stored in the memory device.

12. The gaming device of claim 10, which includes a displayed item associated with the actor and the audio message.

13. The gaming device of claim 10, wherein at least one of the award changes from each of a plurality of said award profiles includes an award decrease.

14. A gaming device comprising:

a plurality of award profiles, each award profile including a predetermined number of predefined award changes, wherein the number is at least two, wherein at least one of the award changes of at least one of said award profiles includes an award downgrade;

a plurality of audio messages associated with the award changes of each award profile;

means for playing said audio messages;

a display device; and a processor that: (i) randomly selects one of the award profiles, (ii) causes the display device to display the award changes of the selected award profile, (iii) causes the playing means to play the audio messages associated with the award changes of the selected profile, and (iv) provides an award to the player based on the selected award profile.

15. The gaming device of claim 14, wherein a plurality of the award changes of at least one of said award profiles includes an award downgrade.

16. The gaming device of claim 14, wherein at least one of the award changes of each of the plurality of said award profiles includes an award downgrade.

17. The gaming device of claim 14, wherein the predefined award changes of the award profiles include incremental changes.

18. The gaming device of claim 14, wherein the predefined award changes of the award profiles are selected from a pool of potential predefined award changes.

19. The gaming device of claim 14, wherein the predefined award changes of the award profiles include fixed amounts.

20. The gaming device of claim 14, wherein the predefined award changes of the award profiles include randomly determined amounts.

21. The gaming device of claim 14, which includes a plurality of selectable items displayed by said display device, wherein each item is associated with one of the award profiles.

22. The gaming device of claim 14, which includes an actor displayed by said display device, said actor appearing on the display device in conjunction with the playing of the audio messages associated with the selected award profile.

23. The gaming device of claim 22, wherein the processor randomly selects the actor from a plurality of actors.

24. The gaming device of claim 22, wherein said plurality of messages are associated with the selected and displayed actor.

25. The gaming device of claim 14, wherein said audio messages include human voice recordings.

26. A gaming device comprising:

a plurality of award profiles, each award profile including a predetermined number of predefined award changes, wherein the number is at least two, wherein at least one of the award changes of at least one of said award profiles includes an award downgrade;

a plurality of human voice recordings associated with the award changes of each award profile;

means for playing said plurality of human voice recordings;

a display device; and a processor that (i) randomly selects one of the award profiles, (ii) causes the display device to display the award changes of the selected award profile, (iii) causes the playing means to play the plurality of human voice recordings associated with the award changes of the selected profile, and (iv) provides an award to the player based on the selected award profile.

27. The gaming, device of claim 26, wherein a plurality of the award changes of at least one of said award profiles includes an award downgrade.

28. The gaming device of claim 26, wherein the predefined award changes of the award profiles include incremental changes.

29. The gaming device of claim 26, wherein the predefined award changes of the award profiles are selected from a pool of potential predefined award changes.

30. The gaming device of claim 26, wherein the predefined award changes of the award profiles include fixed amounts.

31. The gaming device of claim 26, wherein the predefined award changes of the award profiles include randomly determined amounts.

32. A method of operating a gaming device comprising the steps of:

(a) generating an award profile from a plurality of award profiles which each include a predetermined number of award changes, wherein the number is at least two, the award profiles each including first and second sets of values, each set including a plurality of values, and wherein at least one of the values of at least one of the sets operates to decrease a player's award;

(b) selecting a first value from the first set of the generated award profile and providing the first value to the player; and (c) selecting a second value from the second set of the generated award profile and providing the second value to the player.

33. The method of claim 32, which includes providing an initial award to the player, wherein providing the first value to the player includes combining the first value and the initial award.

34. The method of claim 32, which includes providing an initial award to the player, wherein providing the first value to the player includes replacing the initial award with the first value.

35. The method of claim 32, wherein providing the second value to the player includes combining the first value and the second value.

36. The method of claim 32, wherein providing the second value to the player includes replacing the first value with the second value.

37. The method of claim 32, which includes a plurality of sets of values and the steps of selecting and providing one of the values from each of the sets to the player.

38. The method of claim 32, wherein the values of at least one of the sets is weighted so that selecting from the weighted set includes selecting one of the values more often than another one of the values.

39. The method of claim 32, wherein the award profiles are stored in a database.

40. The method of claim 32, wherein steps (a) to (c) are provided via a data network.

41. The method of claim 40, wherein the data network is an internet.

42. A method of operating a gaming device comprising the steps of:

(a) generating an award profile from a plurality of award profiles, the award profiles each including a plurality of sets of values, each set including a plurality of values which operate to change an award a predetermined number of times wherein the number is at least two, and wherein at least one of the values of at least one of the sets operates to decrease a player's award;

(b) selecting a first value from one of the sets of the generated award profile and providing the first value to a player; and (c) selecting a second value from another one of the sets of the generated award profile, combining the second value with the first value, and providing the combined value to the player.

43. The method of claim 42, which includes providing positive and negative values and structuring the values of the sets so that the combined value is non-negative.

44. The method of claim 42, wherein the award profiles are stored in a database.

45. The method of claim 42, wherein steps (a) to (c) are provided through a data network.

46. The method of claim 45, wherein the data network is an internet.

47. A method of operating a gaming device comprising the steps of:

(a) generating an award profile from a plurality of award profiles which each include a predetermined number of award changes and wherein the number is at least two, the award profiles each including a plurality of sets of values, each set including a plurality of values, and wherein at least one of the values of at least one of the sets operates to decrease a player's award;

(b) selecting a first value from one of the sets of the generated award profile and providing the first value to a player; and (c) selecting a second value from another one of the sets of the generated award profile, replacing the first value with the second value, and providing the second value to the player.

48. The method of claim 47, which includes structuring the values of the sets so that the second value is non-negative.

49. The method of claim 47, wherein the award profiles are stored in a database.

50. The method of claim 47, wherein steps (a) to (c) are provided through a data network.

51. The method of claim 50, wherein the data network is an internet.

52. A method operating a gaming device comprising:

(a) providing an initial award to a player;

(b) randomly generating a first value;

(c) randomly determining whether to increase or decrease the initial award by the first value;

(d) increasing or decreasing in accordance with the random determination of step (b) the initial award by the first value to create a modified award;

(e) randomly generating a second value;

(f) randomly determining whether to increase or decrease the modified award with the second value; and (g) increasing or decreasing in accordance with the random determination of step (f) the modified award by the second value and providing an award based thereon to a player.

53. The method of claim 52, wherein the increasing or decreasing includes incrementally increasing or decreasing by the amount of one of the values.

54. The method of claim 52, wherein the increasing or decreasing includes replacing an award with one of the values.

55. The method of claim 52, wherein steps (a) to (c) are provided through a data network.

56. The method of claim 55, wherein the data network is an internet.

57. A method for operating a gaming device, said method comprising the steps of:

(a) enabling a player to select an item from a plurality of displayed items;

(b) after said player picks one of the items, generating an award profile from a plurality of award profiles, wherein at least one of the profiles includes an award decrease, and each award profile has a predetermined number of award changes, wherein said number is at least two;

(c) playing a different audio message associated with each award change of said generated award profile based on said selected item; and (d) providing an award to the player based on the generated award profile.

58. The method of claim 57, which includes displaying an actor providing said audio messages, wherein the audio messages are associated with said actor.

59. The method of claim 57, which includes displaying an initial award, wherein playing said audio messages includes providing an explanation for said initial award.

60. The method of claim 57, wherein playing said audio message includes providing an explanation for each award change.

61. The method of claim 57, which includes displaying the award changes of the award profile on a display device.

62. The method of claim 57, wherein the award profiles, the items and the audio messages are stored in at least one database.

63. The method of claim 57, which is provided through a data network.

64. The method of claim 63, wherein the data network is an internet.

65. A method for operating a gaming device, said method comprising the steps of:

(a) enabling a player to select an item from a plurality of displayed items;

(b) generating an award profile having a predetermined number of award changes, wherein said number is at least two and one of said award changes includes at least one award decrease;

(c) displaying an actor that performs an action associated with the each award change; and (d) playing an audio message associated with said selected item and said displayed actor, said message providing an explanation for each award change.

66. The method of claim 65, which is provided through a data network.

67. The method of claim 66, wherein the data network is an internet.

* * * * *